United States Patent [19]

Toll

[11] Patent Number: 5,037,584

[45] Date of Patent: Aug. 6, 1991

[54] HELICAL INSERT FOR A CARBONATOR AND METHOD OF CONDUCTING CARBONATED LIQUID

[76] Inventor: Duncan M. Toll, 48 Sharp Hill Rd., Wilton, Conn. 06897

[21] Appl. No.: 480,627

[22] Filed: Feb. 15, 1990

Related U.S. Application Data

[63] Continuation of Ser. No. 410,009, Sep. 20, 1989, abandoned, which is a continuation of Ser. No. 310,466, Feb. 15, 1989, abandoned, which is a continuation of Ser. No. 213,334, Jun. 30, 1988, abandoned.

[51] Int. Cl.[5] ..... B01F 3/04

[52] U.S. Cl. ..... 261/76; 261/DIG. 7; 366/339

[58] Field of Search ..... 261/76, DIG. 7, DIG. 16; 366/338, 339

[56] References Cited

U.S. PATENT DOCUMENTS

| | | | |
|---|---|---|---|
| 906,555 | 12/1908 | Pein | 261/DIG. 7 |
| 1,373,829 | 4/1921 | Perdue | 366/339 |
| 2,132,011 | 10/1938 | Bennett et al. | 261/DIG. 7 |
| 2,654,585 | 10/1953 | Heesen | 261/19 |
| 2,726,841 | 12/1955 | Crist | 261/DIG. 7 |
| 4,133,485 | 1/1979 | Bouvin | 366/339 |
| 4,537,513 | 8/1985 | Flesher et al. | 366/339 |

FOREIGN PATENT DOCUMENTS

| | | | |
|---|---|---|---|
| 2356595 | 5/1975 | Fed. Rep. of Germany | 366/339 |

*Primary Examiner*—Tim Miles

*Attorney, Agent, or Firm*—Kenyon & Kenyon

[57] ABSTRACT

Carbonated liquid under pressure is conducted to a point which is at a pressure close to atmospheric pressure without excessive loss of carbonation over a helical flow path formed from a tubular member having an inner circumference and a helical insert having a threaded portion disposed within the tubular member with the threaded portion and the inner circumference together defining the helical flow path. The helical insert has an upstream end formed with a pointed nose adjacent one end of the threaded portion and a downstream end formed as a flat tail adjacent the other end of the threaded portion. The helical flow path has a predetermined length and essentially constant cross section which tends to reduce the pressure of the solution without excessive loss of carbonation.

14 Claims, 11 Drawing Sheets

HELICAL INSERT FOR A CARBONATOR AND METHOD OF CONDUCTING CARBONATED LIQUID

This application is a continuation of application Ser. No. 07/410,009, filed Sept. 20, 1989, now abandoned, which is a continuation of application Ser. No. 07/310,466, filed Feb. 15, 1989, now abandoned, which is a continuation of application Ser. No. 07/213,334, filed June 30, 1988, now abandoned.

The invention relates generally to an apparatus for conducting a carbonated liquid under pressure to a point which is at a pressure close to atmospheric without excessive loss of carbonation and more particularly to such apparatus which can be used in combination with a removable carbonator, particularly useful in in-home drink dispensers which dispense drinks made of a mixture from a concentrate (e.g., syrup) and a diluent (e.g., carbonated water).

BACKGROUND OF THE INVENTION

This invention can be incorporated as an improvement in the carbonator disclosed in co-pending U.S. patent application Ser. No. 799,911, filed Nov. 20, 1985, now abandoned in favor of application Ser. No. 07/257,128, filed Oct. 7, 1988, now abandoned in favor of application Ser. No. 07/511,941 which is admitted to be prior art to the invention. FIGS. 1–13 and the description thereof describe the admitted prior art.

The invention is directed to the long standing problem of maintaining the desired degree of carbonation in a carbonated liquid. For example, in post-mix dispensers, carbonated water is combined with a concentrate, such as syrup, to make a drink for the consumer. The carbonated water is produced in a pressurized vessel, typically called a carbonator, which generates a solution of water and dissolved gas ($CO_2$). Due to the pressurization of the carbonator and the requirement that the fluid be delivered to the consumer at ambient conditions, some method of flow control must be used to provide a consumer-acceptable flow rate of the carbonated water upon dispensing. The problem in controlling the flow arises because the solution of water and dissolved gas, i.e., the carbonated water, is an unstable mixture. At standard temperatures and pressures, the carbon dioxide gas tends to come out of solution. This tendency is accelerated if the solution is exposed to any severe turbulent flow or sudden pressure drops. A similar problem arises in pre-mix dispensers where a mixture of carbonated water and syrup is dispensed.

Several solutions to the problem of controlling the flow rate of the carbonated liquid while maintaining the dissolved gas in solution have been attempted with unsatisfactory results. For instance, as described in more detail subsequently in FIGS. 1–13, an expansion chamber can be provided to attempt to prevent the loss of carbonation when dispensing. The expansion chamber itself is kept at a cold temperature and is a gradually enlarging chamber which permits a gradual expansion and lowering of pressure from the pressure inside the carbonated tank, typically approximately 50 psi, to atmospheric pressure at the point where the carbonated water is dispensed to form a drink. The expansion chamber was used in combination with a anti-surge valve which acted to reduce the pressure in the expansion chamber to a level which would allow dispensing upon initial opening of the dispensing valve without spitting or sputtering. The expansion chamber did not provide satisfactory results because the inside diameter of the expansion chamber was so large that the carbonated solution was not in containment and therefore too much space was available for gas which readily came out of solution.

Another solution that was attempted was provision of a standard orifice of approximately 0.052 inches in diameter having a land distance of approximately 0.032 inches as the primary flow control. This is shown in FIG. 13A. The orifice was mounted at the outlet of the expansion chamber thereby effectively eliminating the reduced pressure effect of the expansion chamber. The above-mentioned anti-surge valve also was eliminated. Although this arrangement produced better results than the expansion chamber, it also was unsatisfactory because a rapid pressure drop and turbulent flow conditions were produced which tended to drive the dissolved carbon dioxide out of the solution.

SUMMARY OF THE INVENTION

Applicants' invention prevents the excessive loss of carbonation when conducting a carbonated liquid under pressure to a point at a pressure close to atmospheric by provision of means forming a helical flow path of predetermined length and essentially constant cross section as the primary flow control for conducting the carbonated liquid.

The means forming the helical flow path comprises a tubular member having an inner circumference and a helical insert having a threaded portion disposed within the tubular member with the threaded portion and the inner circumference together defining the helical flow path. The helical insert has an upstream end formed with a pointed nose adjacent one end of the threaded portion and a downstream end formed as a flat tail adjacent the other end of the threaded portion. The threaded portion of the helical insert may comprise two independent sets of threads which define two separate and parallel helical flow paths. A bypass path or paths forming flow channel(s) bypassing the helical flow paths may be formed by cutouts extending along the length the threaded portion. The cross sectional area of the helical flow paths may be approximately semi-circular in shape. Particularly advantageous results may be obtained when the length of the threaded portion equals approximately one inch with threads formed thereon at a spacing of 5 threads per inch, the length of the pointed nose equals approximately 0.25 inches, the outside diameter of the threaded portion equals approximately 0.30 inches, the outside diameter at the base of the pointed nose equals approximately 0.20 inches and the projected area of each of the helical flow paths equals approximately 0.0503 square inches. The inner circumference of the tubular member is tapered to cooperate with the threaded portion of the helical insert for fine adjustment of the cross sectional area of the flow path The threaded portion of the helical insert may be formed from a resilient plastic material, such as polycarbonate, which is compressed as it is further inserted into the taped bore to reduce the cross sectional area of the helical flow path.

In general, the beneficial effects of applicants' invention can be obtained whenever it is desired to conduct a carbonated liquid under pressure to a point at a reduced pressure without excessive loss of carbonation. As illustrated herein, the invention is described in combination with a carbonator forming part of a drink dispenser. In such a case, the carbonated liquid under pressure is carbonated water and the carbonator comprises a tank containing water to be carbonated, a gas inlet connected to a source of pressurized gas, means for carbonating the water within the tank and an outlet for carbonated water. The helical flow path is disposed in the interior of the tank upstream of the carbonated water outlet. It is beneficial to have the helical flow path within the carbonator in order to keep the carbonated water and helical flow path at the same temperature. Although disclosed with a specific carbonator, the present invention is generally applicable when it is required to conduct carbonated liquid under pressure to a point near atmospheric pressure without excessive loss of carbonation.

A method of conducting a carbonated liquid under pressure via a helical flow path to a point which is at a pressure close to atmospheric without excessive loss of carbonation is also disclosed.

BRIEF DESCRIPTION OF THE DRAWINGS

FIG. 1 is an exploded view of the prior art carbonator and mounting assembly.

FIG. 2 is an exploded view of the assembly inserted inside the carbonator.

FIG. 3 is an elevation view of the assembly shown partially in cross section.

FIG. 4 is a plan view of the assembly shown in FIG. 2.

FIG. 5 is a plan view, partially in cross section, of the expansion chamber of FIG. 2.

FIG. 6 is a cross sectional view of the expansion chamber of FIG. 5 taken along the lines 6—6.

FIG. 7 is a cross sectional view taken along the lines 7—7 of FIG. 5.

FIG. 8 is a cross sectional view taken along the lines 8—8 of FIG. 5.

FIG. 9 is an elevational view of the expansion chamber.

FIG. 10 is a partial cross sectional view through the feed line and diffuser of the carbonator assembly.

FIGS. 11 and 12 are cross sectional views of portions of the diffuser and resin bed.

FIG. 13 is a cross sectional view through the resin bed showing its connection to the expansion chamber in which the anti-surge valve of the prior art is disposed.

FIG. 14 is an elevational view of the improved carbonator assembly before insertion into the carbonator.

FIG. 15 is an exploded view of the helical flow insert and the outlet flow tubular member of the carbonator assembly.

FIG. 16 is an exploded view of the carbonator assembly, shown partly in cross section, illustrating the helical flow control insert in place within the tubular member.

FIG. 17 is an enlarged broken view of a helical insert constructed according to the principles of the invention.

FIG. 18 is a plan view of the pointed end of the helical flow insert of FIG. 17.

FIG. 19 is a cross sectional view of the flow path area between two adjacent lands of threads formed on the helical insert illustrated in FIG. 17.

DETAILED DESCRIPTION

Figure 1:
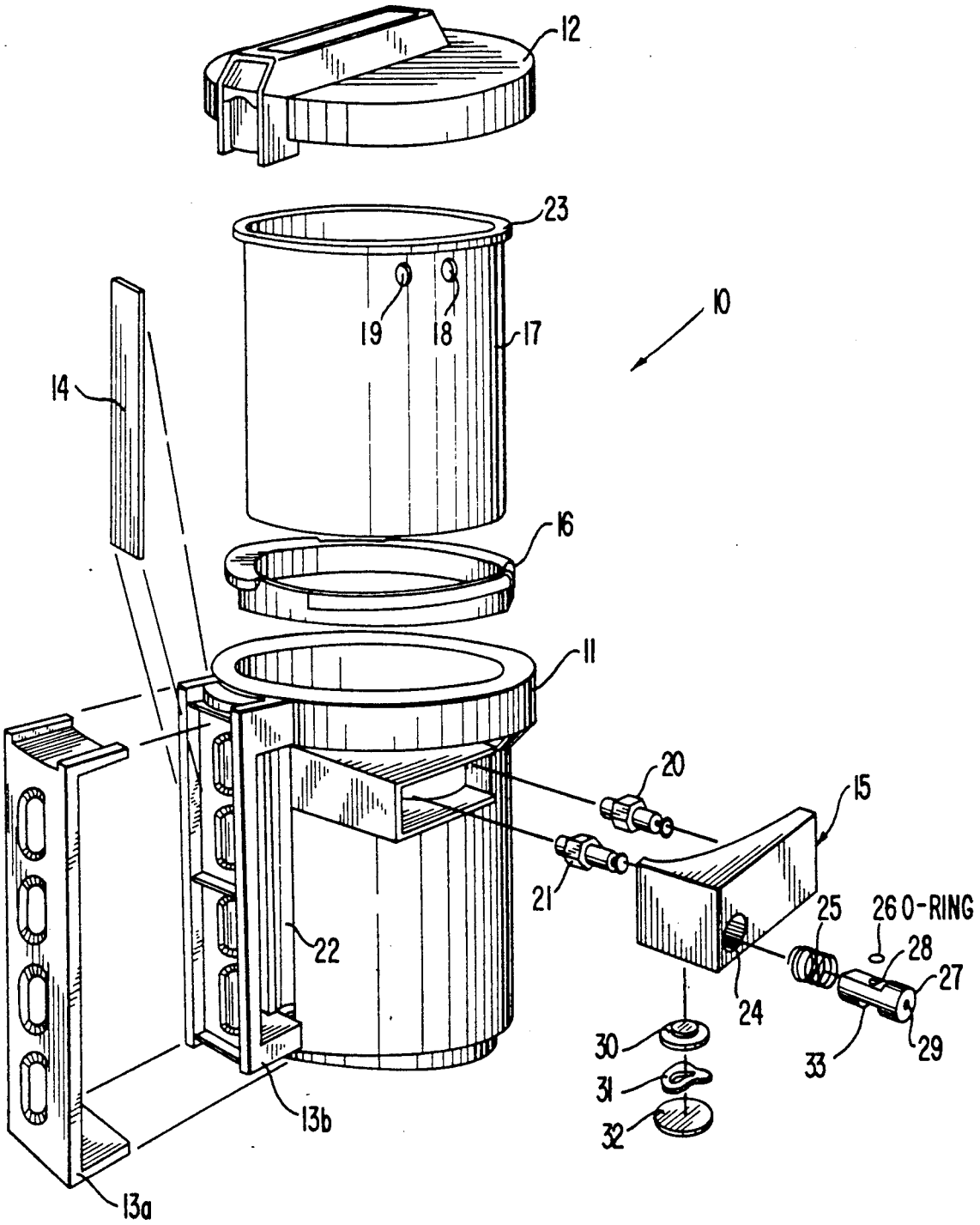
FIG. 1 (PRIOR ART)
FIGS. 1–13 describe the admitted prior art discussed generally in the Background of the Invention.

FIGS. 1–13 illustrate one of the prior art carbonator assemblies previously discussed. FIG. 1 is an exploded view of the carbonator 10 and the carbonator connecting assembly 15. Connecting assembly 15 is adapted to removably mate with a corresponding part of a dispenser, such as an in-home drink dispenser of the type disclosed in U.S. patent application Ser. No. 799,911, for removably connecting the carbonator to the dispenser in a manner well known in the art. The outer body 11 of the carbonator is made of molded plastic. Inserted into the top of body 11 is a molded plastic ring 16. Into the plastic ring 16 a stainless steel carbonator tank 17 is inserted. The tank 17 contains holes 18 and 19. When in place, these holes receive fittings 20 and 21. The fittings 20 and 21 are the carbon dioxide inlet and the carbonated water outlet, respectively. They are inserted into respective bores of the carbonator connecting assembly 15 (not shown).

The carbonator 10 is provided with a handle made up of a portion 13*b* molded onto the body 11 and another portion 13*a* inserted thereover. A liquid crystal strip 14 containing an adhesive backing is attached to the tank 17 through an opening 22 provided in the outer case 11 behind handle portion 13*b*.

The liquid crystal strip 14 responds to temperatures close to 0° C., having one color for temperatures above and another for temperatures below. The handle portions 13*a* and 13*b* are provided with openings so the strip 14 may be viewed therethrough. The carbonator is normally filled with water and ice. Thus, strip 14 gives an indication of water level in the tank.

The ring 16 contains threads to engage the lid 12. Thus, the lip 23 of the tank is trapped between the mounting ring 16 and the lid 12 to obtain a good seal. The carbonated water outlet opening bore 24 can be seen on the front of the carbonator connecting assembly 15. A shuttle valve assembly is inserted into bore 24. Into the base of the bore 24, which is in fluid communication with the carbonated water outlet fitting 21, is inserted a biasing spring 25. An O-ring seal 26 and a shuttle valve member 27 are inserted next. The shuttle member 27 has an inlet port 28 and an outlet port 29. From the bottom of the carbonator connecting assembly 15 a guide and stop member 30 for the shuttle valve member 27, a biasing spring 31 and a retaining disk 32 are inserted. Member 30 cooperates with the lands at the distal ends of slot 33 to define the extreme positions of shuttle valve member 27.

As is well known in the art, shuttle valve member 27 forms a carbonated water dispensing valve for carbonated water conducted thereto from outlet fitting 21. Spring 25 biases member 27 to a closed position in which inlet opening 28 is covered by a portion of bore 24 to prevent flow of carbonated water through the valve. When shuttle valve member 27 is depressed to compress spring 25, inlet 28 opens to a passage (not shown) in fluid communication with carbonated water outlet fitting 21. Carbonated water can then flow from outlet fitting 21 to the dispensing apparatus which forms no part of the invention described herein. The carbonated water dispensing valve member 27 may be operated simultaneously with another valve (not shown) controlling the flow of concentrate, e.g., syrup, to the consumer's drink container such that carbonated water and syrup are simultaneously dispensed.

Figure 2:
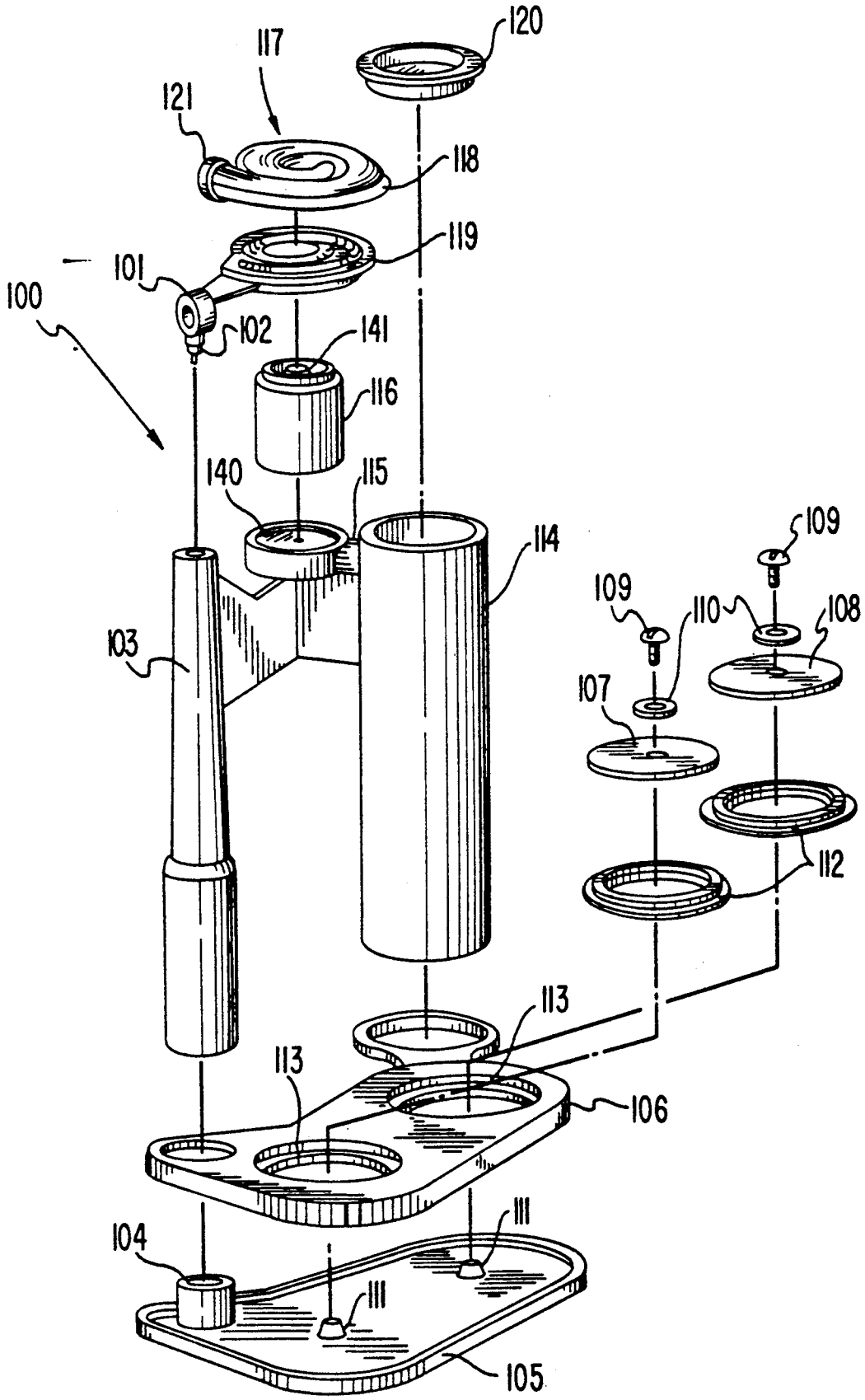
FIG. 2 (PRIOR ART)
Figure 4:
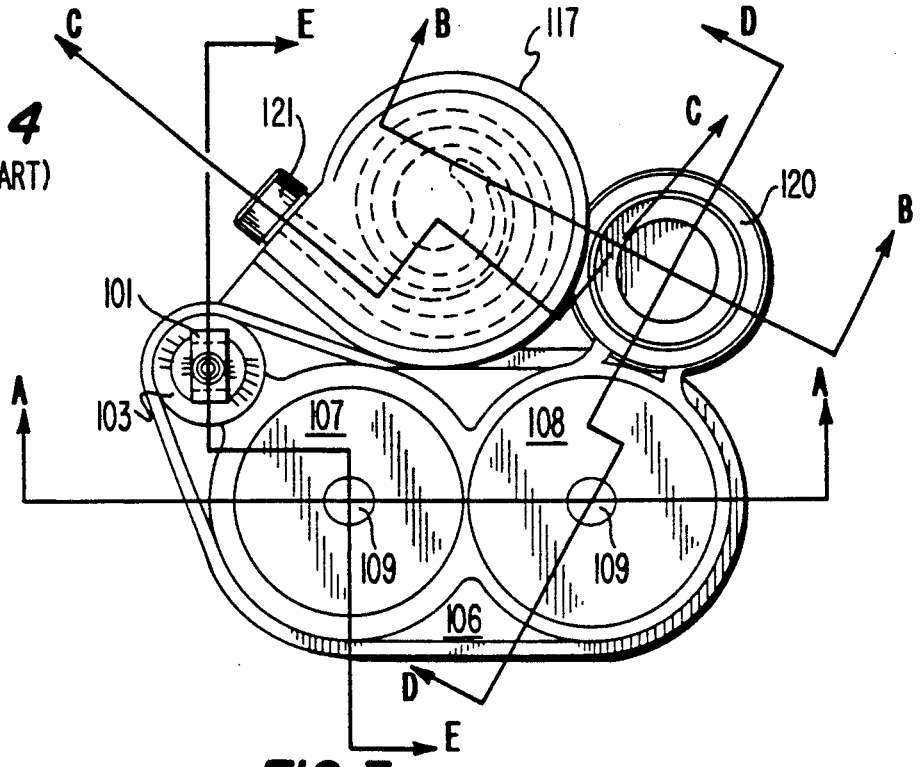
FIG. 4 (PRIOR ART)
Figure 3:
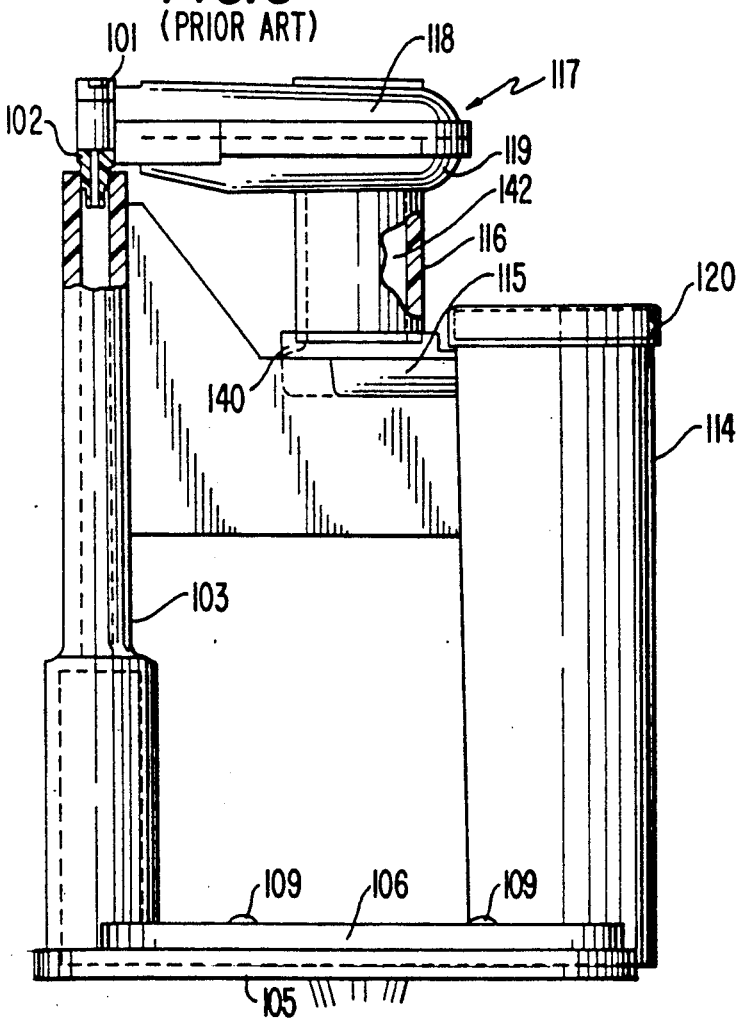
FIG. 3 (PRIOR ART)

As previously described, fittings 21 and 20 pass through openings 19 and 18, respectively, in the stainless steel carbonator tank 17. FIG. 2 is an exploded view of the prior art carbonator assembly 100 disposed within the carbonator. Fittings 21 and 20 mate with portions of assembly 100 as subsequently discussed. FIGS. 3 and 4 are elevation views and plan, respectively, of this assembly. The carbon dioxide gas inlet fitting 20 is coupled to a fitting 101 which is in the nature of an elbow fitting. The carbon dioxide gas is conducted through an outlet 102 to a tubular member 103 mounted to a cylindrical flange 104 on a base member 105. Contained within the base portion of the tubular member 103 is a slow-feed valve regulating the flow of carbon dioxide gas to interior of the carbonator. The slow-feed valve may be of the type described in U.S. Pat. No. 4,564,483, the disclosure of which is incorporated herein. A cover 106 is placed over and sealed to the base 105. Gas flows from the outlet of the slow-feed valve to the space between the base and cover and into the tank interior through two diffusers 107 and 108. The diffusers are held in place by gasketed bolts 109 which thread into threaded bosses 111 formed in the base 105 with gaskets 112 interposed between the diffuser 107 and 108 and the cover 106 which has provided therein openings 113 for that purpose. The bolts 109 are provided with gaskets 110 to ensure that no gas leaks around the bolts. The diffusers are disclosed in more detail in U.S. Pat. Nos. 4,555,371 and 4,520,950, the disclosure of which is incorporated herein.

The carbon dioxide gas mixes with water within the tank to form a solution of gas and water commonly known as carbonated water. The carbonated water flows out of the tank through a resin bed assembly 114, the outlet 115 of which is coupled to an anti-surge valve assembly (not shown) inserted into a chamber 142 formed within short tubular member 116. Resin bed assembly 114 is shown as having a sealed lid 120 to permit inserting new charges of resin as the old resin is used up. The outlet 141 of the anti-surge valve is positioned adjacent the inlet 122 (see FIG. 6) of an expansion chamber 117 made up of a top half 118 and a bottom half 119 onto which is also molded the gas inlet fitting 101. Preferably all of these parts are of molded plastic and sealingly assembled to each other in the manner indicated. The expansion chamber 118 terminates in an outlet 121 which is coupled to the carbonated water outlet fitting 21 of FIG. 1.

Figure 5:
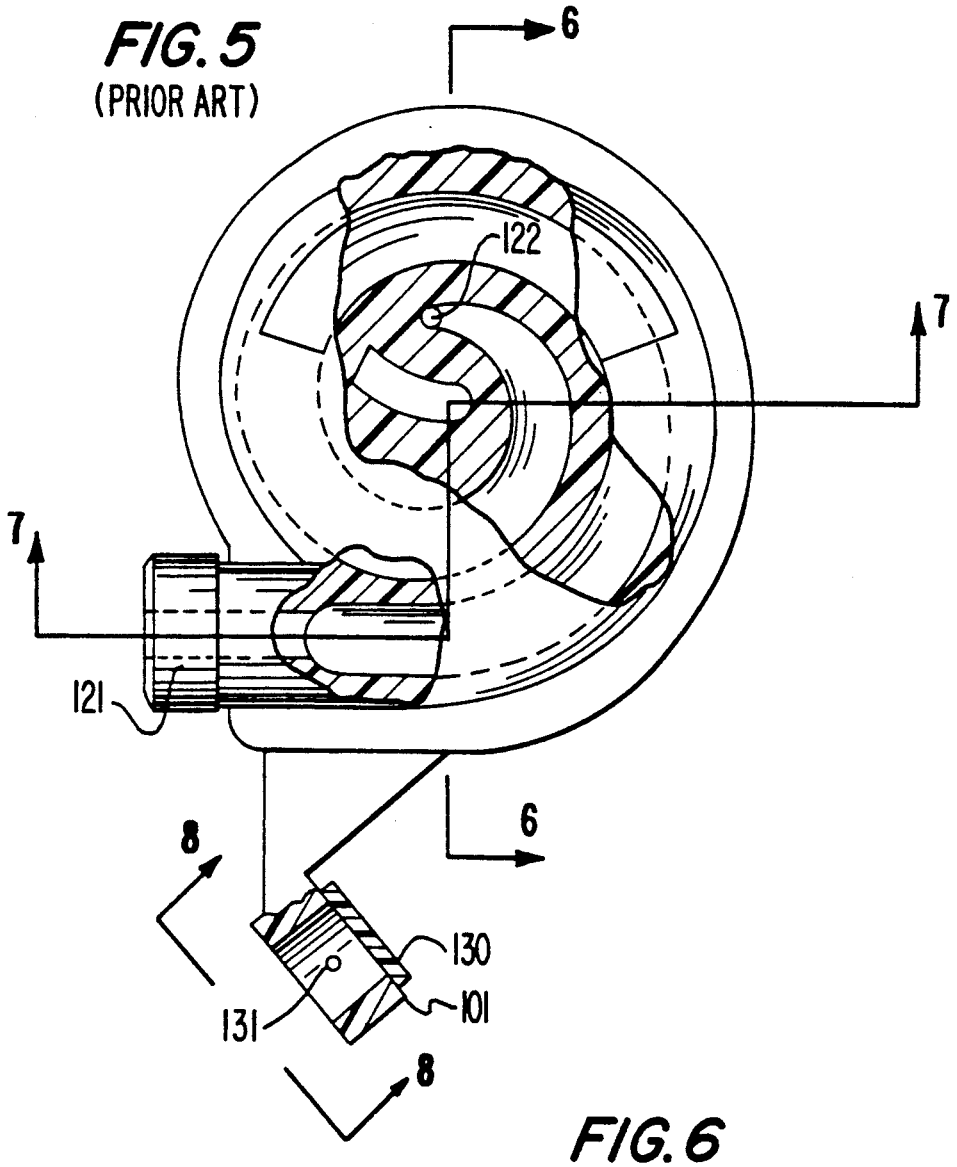
FIG. 5 (PRIOR ART)
Figure 6:
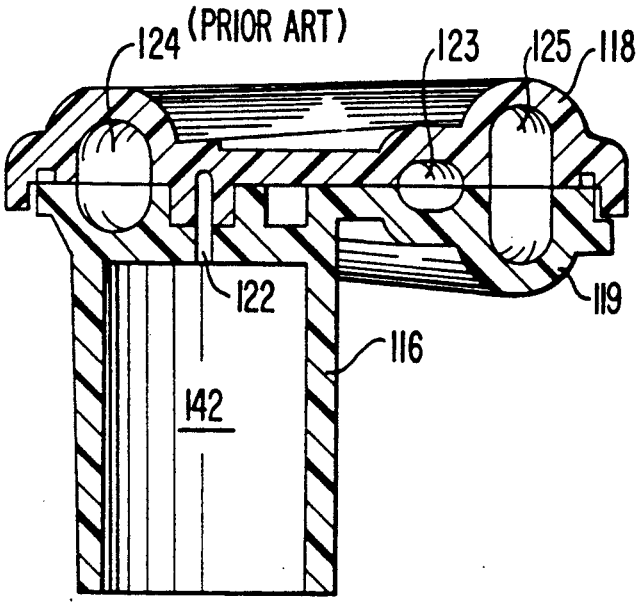
FIG. 6 (PRIOR ART)
Figure 8:
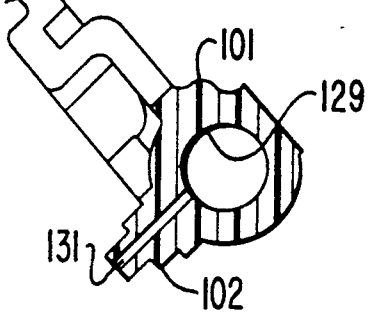
FIG. 8 (PRIOR ART)
Figure 9:
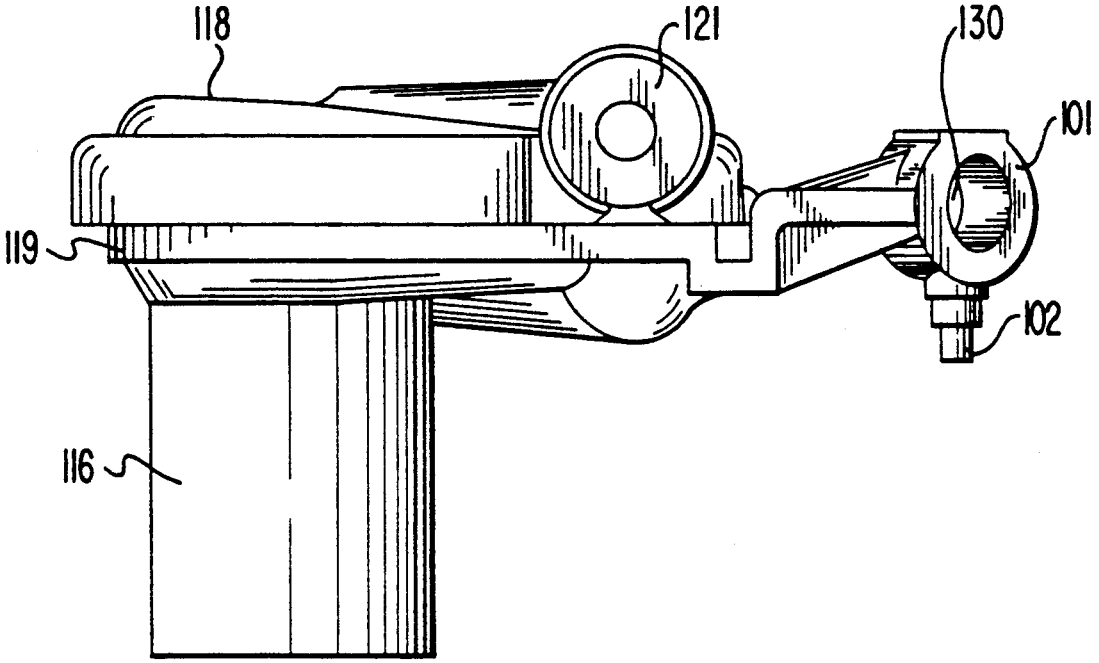
FIG. 9 (PRIOR ART)

The nature of the parts 118 and 119 can be better seen with reference to FIGS. 5–11. Referring to FIGS. 5 and 9, the general shape of the expansion chamber is shown. It has a generally spiral shape beginning at an inlet 122. The chamber has a cross section flow area that gradually expands in size as it spirals around, finally reaching the outlet 121. In the cross section of FIG. 6, the inlet 122 is seen which then expands to the size 123 after 180 degrees, to size 124 after another 180 degrees, and to size 125 after another 180 degrees, which is the size closest to the size at the outlet 121.

Figure 7:
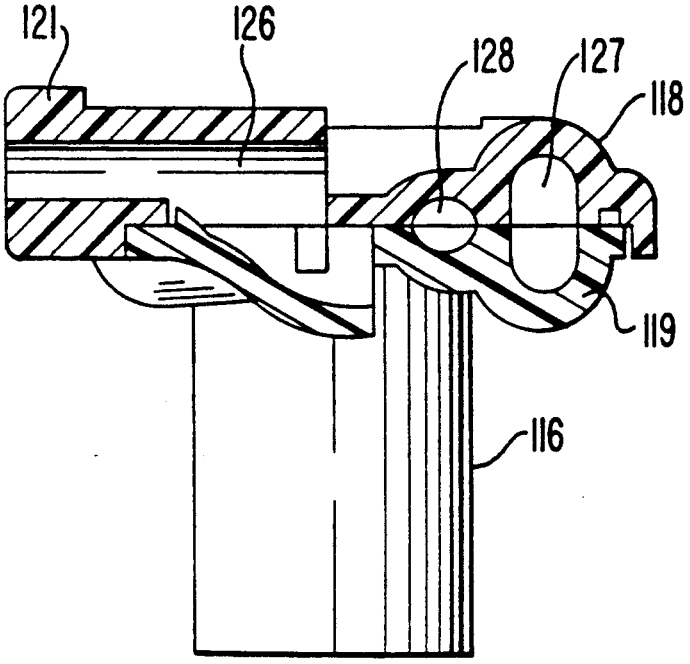
FIG. 7 (PRIOR ART)
Figure 10:
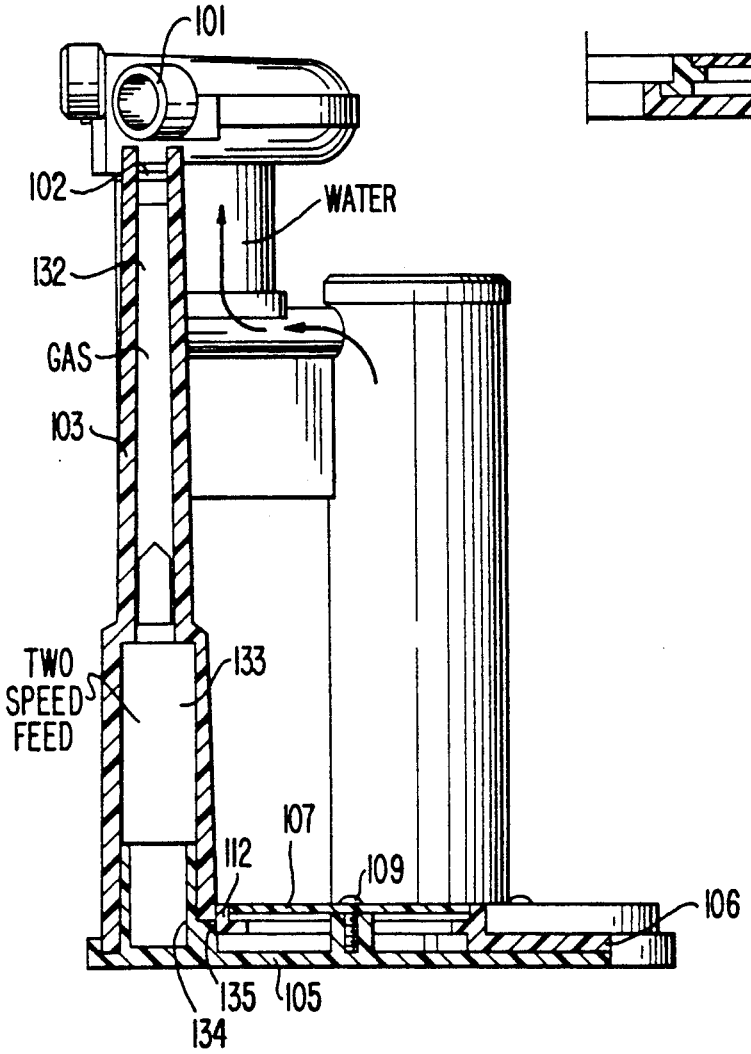
FIG. 10 (PRIOR ART)
Figure 12:
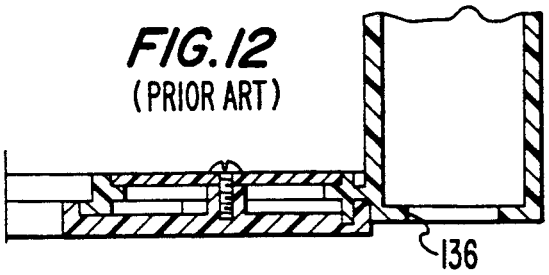
FIG. 12 (PRIOR ART)

The cross section of FIG. 7 shows the outlet fitting 121 and outlet bore 126 and also portions 127 and 128 of the expanding chamber. Each of FIGS. 6 and 7 also shows the member 116 which forms the chamber 142 into which the antisurge valve, previously mentioned, is inserted.

Figure 11:
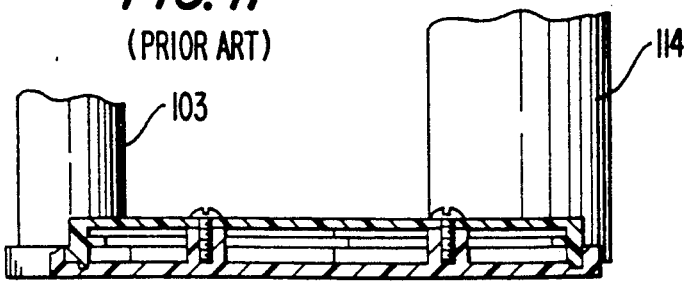
FIG. 11 (PRIOR ART)
Figure 13A:
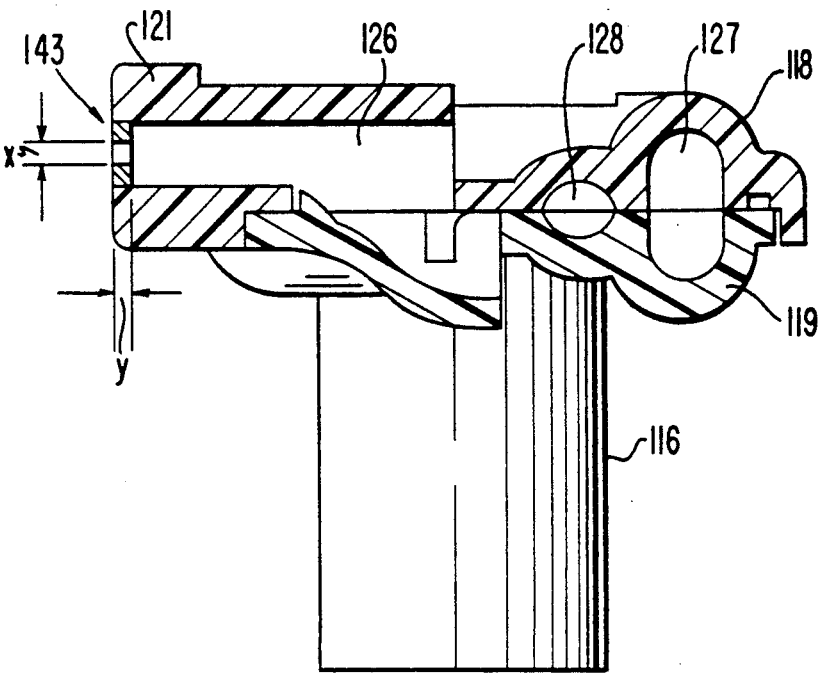
FIG. 13A (PRIOR ART)
FIG. 13*a* is a cross sectional view similar to FIG. 7 showing another previous solution employed in the prior art.
Figure 13:
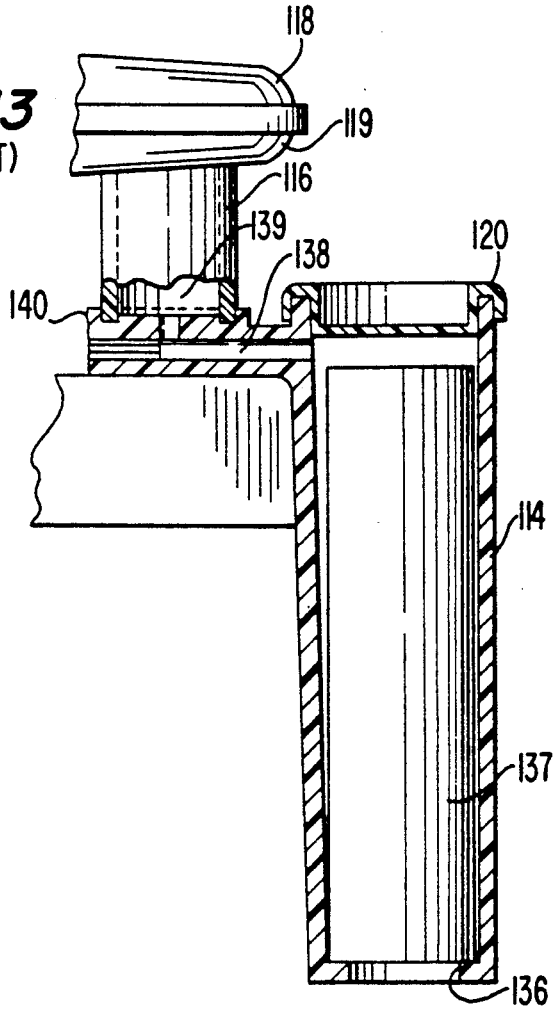
FIG. 13 (PRIOR ART)

FIGS. 5, 8 and 9 also show the construction of the inlet 101 for carbonated dioxide gas. Gas flowing into the inlet 101, i.e., into its bore 129 which is closed off on the opposite side by a disk 130, seen in FIG. 5, then flows through a hole 131 in the outlet fitting 102 and into the tubular member 103 described above. Incoming gas flows through the passage 132 in tubular member 103 seen in FIG. 10. At the base of member 103 the slow-feed or two-speed feed valve assembly 133 is installed. Gas flows out of the bottom of this assembly through openings 134 and 135 into the space between base 105 and lid 106. It then flows through the diffusers 107 and 108 held in place by gasketed screws 109 with gaskets 112 interposed between the cover 106 and the diffusers 107 and 108 seen in FIG. 2. In the cross section of FIG. 12, the inlet 136 in the resin bed can be seen along with a further view of the diffuser assembly. Another view showing the diffuser assembly and the resin bed container 114 is illustrated in FIG. 11. Referring to FIG. 13, the resin bed assembly 114 can be seen in more detail. Inserted sealingly within the resin bed assembly is a cartridge 137 containing beads of resin for filtering and deionizing the water. Water flows through the resin bed 137 to the top thereof and then to an outlet passage 138. This passage extends radially to an axial passage 139 formed in a base portion 140 of the short tubular member 116 which contains the anti-surge valve sealingly inserted therein. Member 116 in turn is attached to part 119 of the expansion chamber in the manner described above.

When the anti-surge valve is inserted into the chamber 142, its valve outlet 141 (shown in FIG. 2) is aligned with the inlet of opening 122. Outlet 141 and inlet opening 122 are of essentially the same diameter so that there is a smooth flow therebetween to avoid loss of carbonation. The purpose of the anti-surge valve is to prevent surging and spitting when the carbonated water valve (i.e., the shuttle valve assembly previously discussed) is first opened. The pressure within the carbonator is typically approximately 50 psi. This pressure must be reduced to atmosphere by the time the carbonated water is discharged from the outlet spout into the consumer's container. The purpose of the spiral expansion chamber was to gradually expand the cross sectional area of the water flow to gradually reduce this pressure so that a gradual pressure reduction takes place without the loss of carbonation. In addition, a smooth flow is assured since sharp edges will break loose the carbon dioxide bubbles, as will any turbulence. However, when the shuttle valve assembly is closed, in the absence of an anti-surge valve, pressure builds up within the expansion chamber. The anti-surge valve prevents excessive pressure build up by closing when the sum of the pressure in the expansion chamber and the pressure of the biasing spring, a sum of typically 30 psi, equals the pressure inside the carbonator. In this manner, a reduced pressure, e.g., 20 psi, is maintained in the expansion chamber and surge problems are reduced. Once the shuttle valve assembly is opened, the pressure within the expansion chamber reduces allowing the pressure in the carbonator to open the anti-surge valve. Carbonated water can then flow through the inlet 122, through the spiral expansion chamber of FIG. 22 to the outlet 121 which is connected to outlet fitting 21, as previously discussed.

As previously mentioned, the expansion chamber arrangement shown in FIGS. 1–13 did not adequately control the flow of carbonated water and the dissolved carbon dioxide gas came out of the solution in unacceptable volumes. FIG. 13*a* shows another prior art attempt to solve the problem of providing an acceptable rate of flow while at the same time avoiding a loss of carbonation when dispensing. The solution shown in FIG. 13*a*, which corresponds to the view shown in FIG. 2, effectively eliminates the expansion chamber by the placement of a standard orifice 143 at the outlet 121. In addition, the anti-surge valve was eliminated when the standard orifice was incorporated. The orifice employed standard dimensions, such as a diameter X of 0.052 inches and a land distance Y of approximately 0.032 inches. Use of this orifice as the primary flow control was found to cause a rapid pressure drop and abusive handling of the fluid which tended to drive the dissolved carbon dioxide out of solution. The following example shows the results obtained with the standard orifice solution discussed above by measuring the input carbonation level, i.e., the carbonation level of solution measured inside the carbonator, and the output carbonation level, i.e., the carbonation level of solution measured downstream of the standard orifice, under given conditions. As known in the art, these levels are measured by a hand terriss tester and represent the volume of dissolved gas (e.g., $CO_2$) per volume of liquid (e.g., $H_2O$) at a given pressure.

| Example 1 - Standard Orifice (Prior Art) | |
|---|---|
| Fluid medium | Carbonated water |
| Input pressure | 50 psig. |
| Flow rate | 24–28 milliliters per second |
| Input Carbonation level | 4.5 volumes of dissolved $CO_2$ |
| Output pressure | near ambient (0–2 psig.) |
| Output carbonation level | 3.1–3.4 volumes of dissolved $CO_2$ |

FIGS. 14–19 illustrate an improved carbonator assembly 200 incorporating the helical flow path of the invention. The basic construction and operation of assembly 200 is the same as that previously described in connection with FIGS. 1–13. However, the expansion chamber and standard orifice have been eliminated, as has been the resin bed. The primary flow control of the carbonated water is accomplished by use of a helical insert shown schematically in FIGS. 15–16 as 201. Helical insert 201 together with the inner circumference of tubular member 227 in which it is inserted define at least one helical flow path having an essentially constant cross sectional flow area over the length of the insert. The helical flow path allows for reduction in pressure of the carbonated water as it flows from the carbonator without any severe turbulent flow or sudden pressure drops that tend to force the carbon dioxide gas out of solution.

Figure 14:
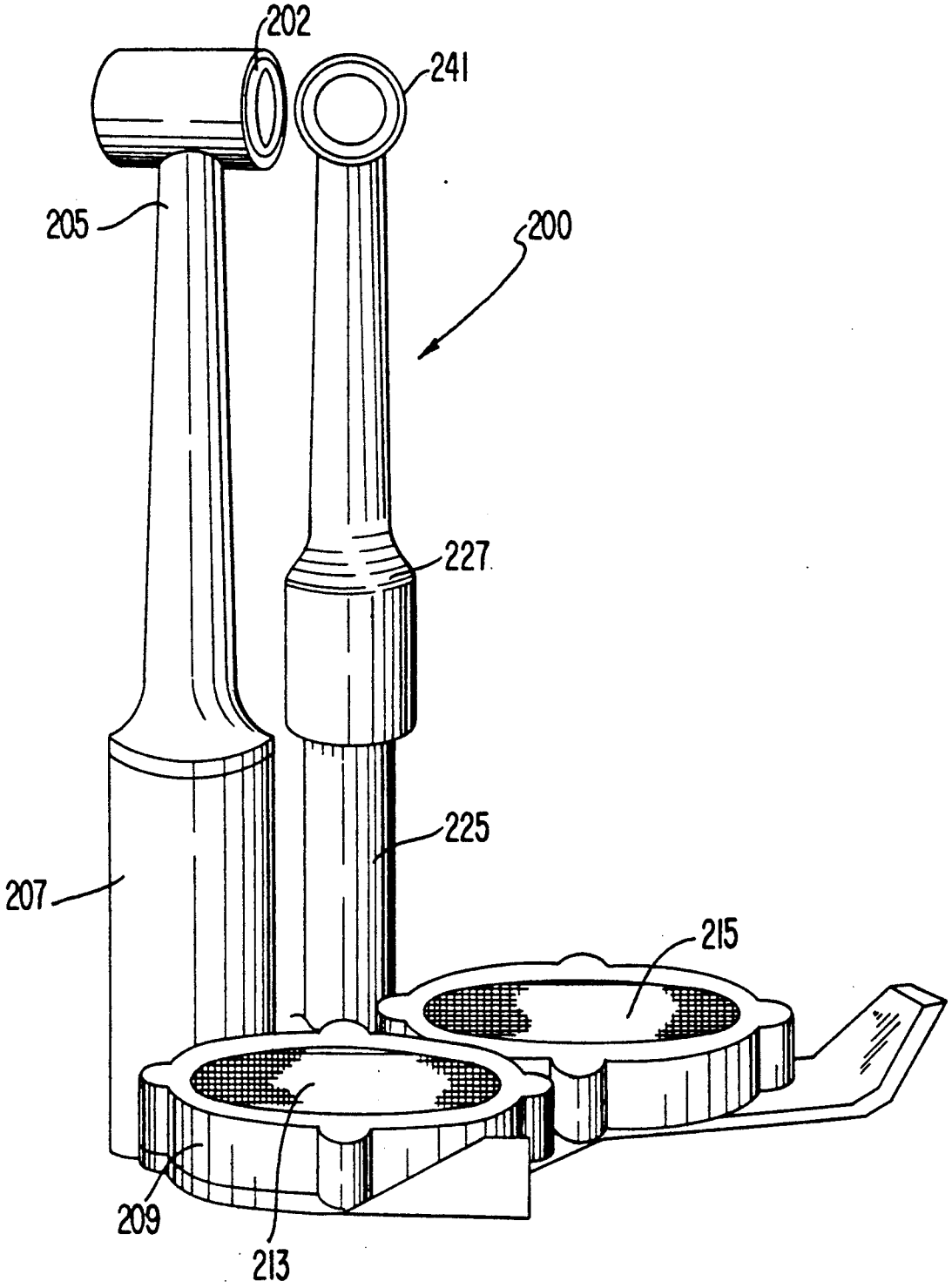
FIGS. 14–19 show the improved carbonator assembly and helical insert constructed according to the principles of the invention.

With the exception of the helical insert, antisputtering valve and resin bed, the carbonator assembly 200 operates in the same basic manner as prior art carbonator assembly 100 shown in FIG. 2. As previously described in connection with the description of FIG. 1, fittings 21 and 20 pass through openings 19 and 18 in the stainless steel carbonator tank 17. The carbon dioxide gas inlet 20 is coupled to a fitting 202 which is in the nature of an elbow fitting. The carbon dioxide gas flows through fitting 202 into a tubular member 205 mounted to a base member 209. Contained within the base portion 207 of tubular member 205 is a slow feed valve which, as previously discussed, may be of the type described in U.S. Pat. No. 4,564,483. Gas flows from inlet fitting 202 through tubular member 205 and the slow feed valve to the interior of base member 209 from which it escapes into the interior of the carbonator via diffusers 213 and 215. The diffusers form means for carbonating the water and may be held in place by a bolt arrangement such as shown in FIG. 2 or may be press fitted such as shown in FIG. 14 or may be fixedly connected by any other convenient means. As previously discussed, the diffusers are disclosed in more detail in U.S. Pat. Nos. 4,555,371 and 4,520,950 the disclosure of which is incorporated herein. The carbonated water within the tank flows through an opening (not illustrated) in conduit 225. From conduit 225 the carbonated water flows to tubular member 227 which contains a helical insert defining at least one helical flow path as subsequently described in detail. The carbonated water leaves the helical flow path at a reduced pressure and flows to an outlet 241 which is connected to the carbonated water outlet fitting 21 of FIG. 1.

Figures 15, 16:
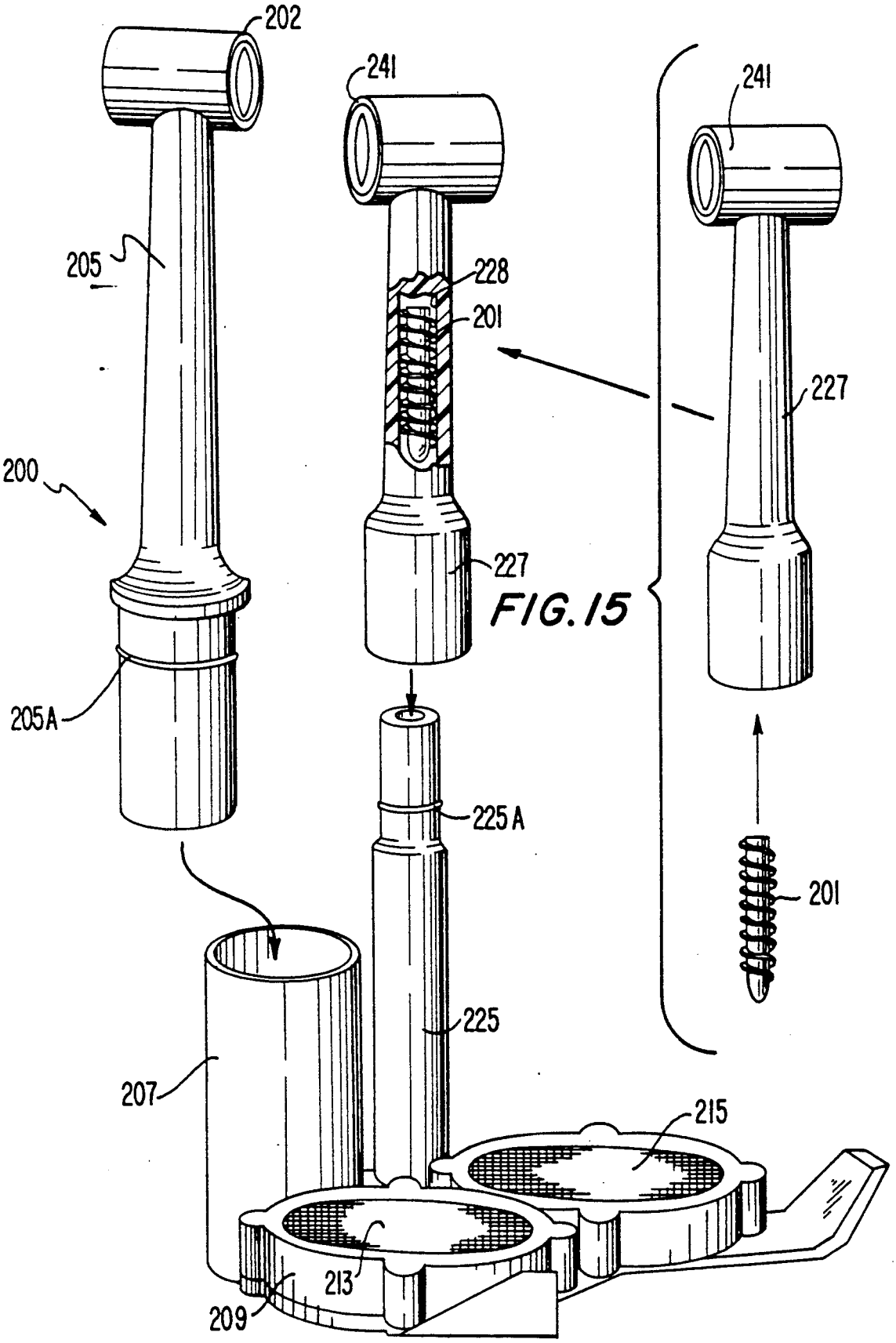

FIG. 15 shows an exploded view of tubular member 227 and helical insert 201. FIG. 16 shows helical insert disposed within tubular member 227 in a partial cutaway view, together with an exploded view of carbonator assembly 200. As shown in FIG. 16, helical insert 201 is inserted within tubular member 227 and held in place by an interference fit. At least one helical flow path of relatively constant cross sectional area over the length L1 is formed between the spirals or threads of the helix and the bore 228 of tubular member 227. In the illustrated embodiment provision of a double start helix having two independent sets of threads allows dual parallel helical flow paths to be produced. In either case, helical insert 201 is press fitted within bore 228 which is tapered. Fine control over the cross sectional area of the helical flow path and hence, the effect of the helical flow path is obtained by the amount of force used in the interference fit and thus how far in the tapered bore the helical insert is forced. This adjusts the cross sectional area of the flow path.

As shown in FIG. 16, tubular member 227 is press fitted onto tubular conduct 225. The connection therebetween is sealed by means of an O-ring 225*a*. Similarly, tubular member 207 which contains the slow feed valve receives tubular member 205 by means of an interference fit which is sealed by O-ring 205*a*. Preferably, all of the parts of assembly 200 are formed from molded plastic and it is understood that the parts are sealingly assembled to each other in the manner indicated.

Figure 17:
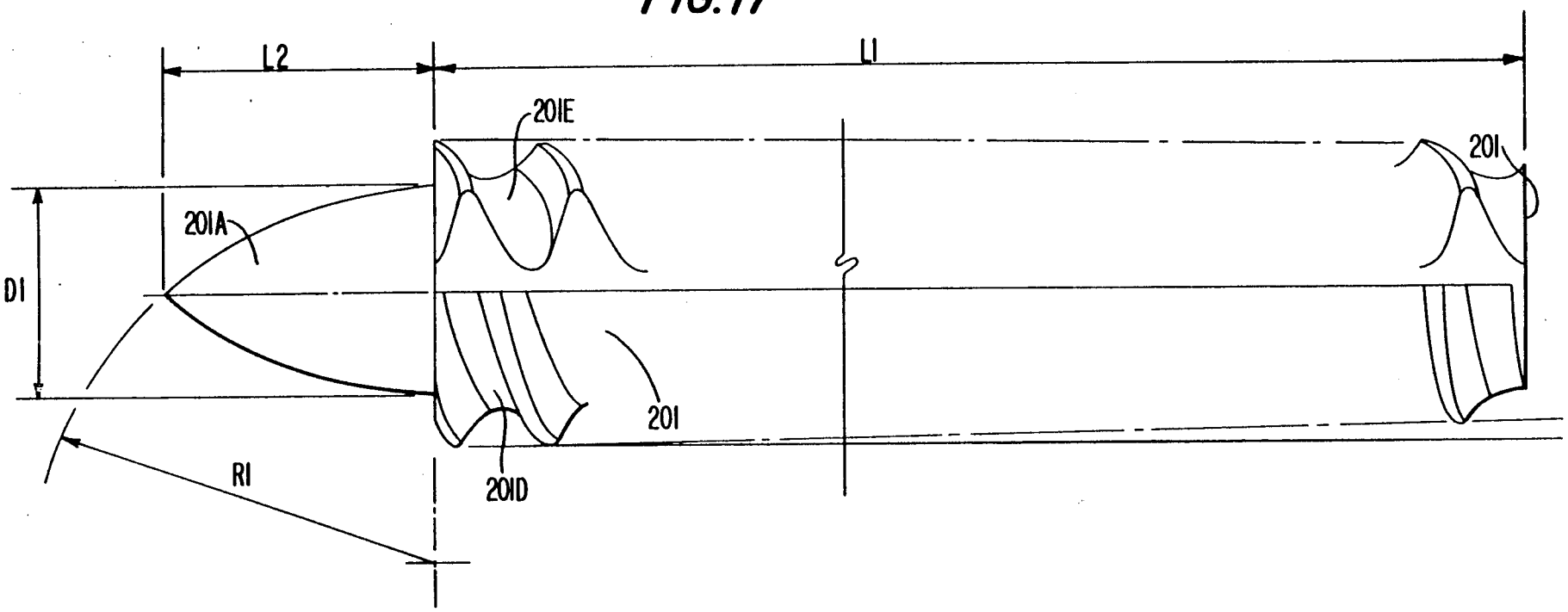
Figure 18:
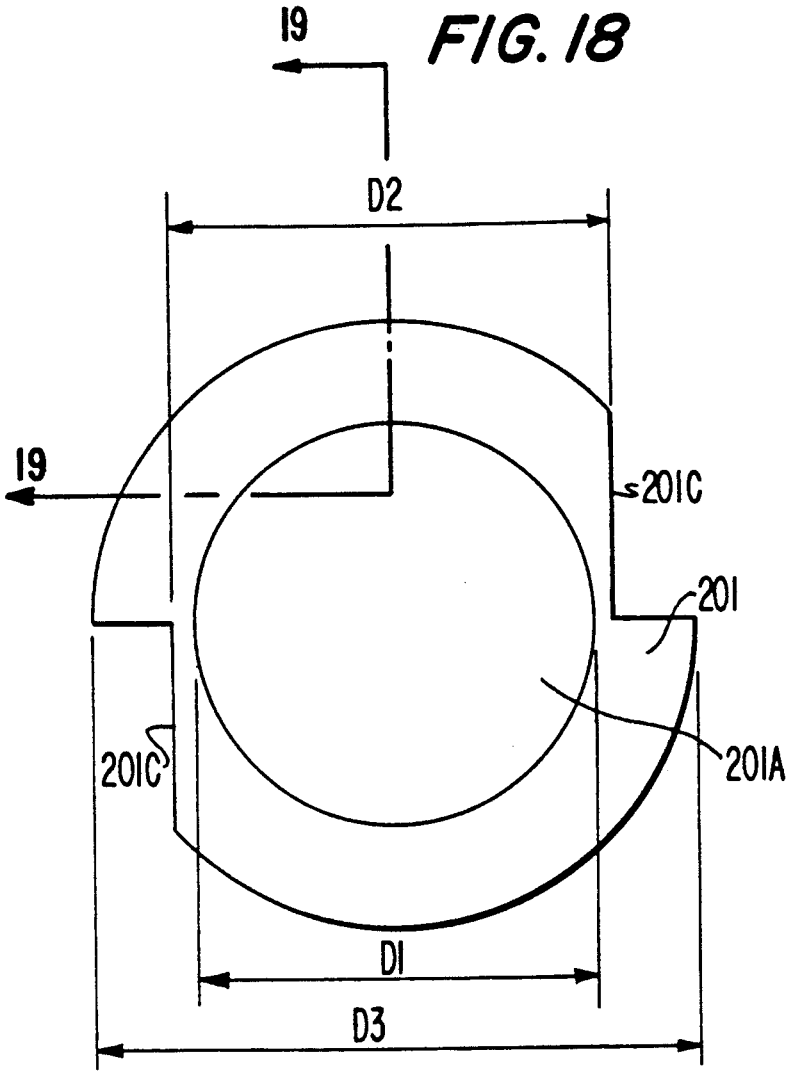
Figure 19:
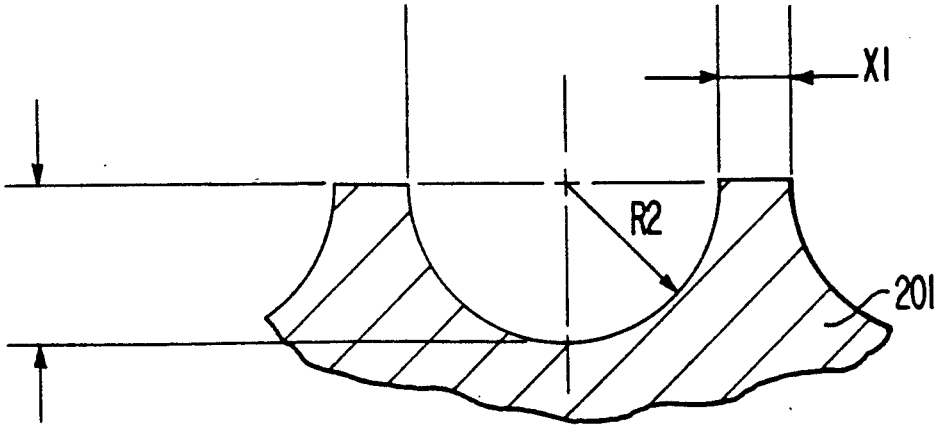

FIGS. 17–19 illustrate a helical insert constructed according to the principles of the invention. The helical insert illustrated in these figures is a double start helix, i.e., two separate helical flow paths are provided. Depending upon the flow characteristics desired, a single start or triple or more start helix could also be employed. FIG. 17 shows a broken side view of the double start helical insert which is similar to a double start screw thread. An important aspect of the invention is provision of a helical insert that will fit inside existing component dimensional restrictions. In this manner, carbonator assemblies such as that shown in FIGS. 1–13 of the prior art can be easily modified to use the improved helical flow path design of the invention. Thus, the outer diameter of the body of the helical insert represented by L1 in FIG. 17 has a diameter D3 shown in FIG. 18 that closely matches the inner diameter of bore 228 of member 227. The helical insert is formed of a plastic material such as polycarbonate to enable the helical insert 201 to be resiliently supported by means of an interference fit within bore 228. In this manner, as previously discussed, the cross sectional area of the helical flow path, defined between the tapered bore 228 and the threads of the helical insert, can be adjusted depending upon how far the helical insert is pushed therein. By further pushing in the helical insert, the outer edges of the threads are deformed inwardly to reduce the cross section.

FIG. 19 is a partial sectional view taken along lines 19—19 of FIG. 18. FIG. 19 shows the flow channel formed between two adjacent threads of the helical insert 201 which is of essentially constant cross sectional area over length L1. The cross section can be reduced by a small amount due to the taper, as discussed above. It is understood that only one of the flow paths of the double start helix is illustrated in FIG. 19. In order to approximate round tubular flow which produces uniform and non-turbulent flow, the projected shape of the flow channel may preferably be semi-circular. Thus, the area between the threads illustrated in FIG. 19 is approximately semi-circular in shape having a radius of R2. The width of each thread at its radially outward most portion is shown at X1. It has been found that the greater the length of the helical channel or channels, the more the carbon dioxide gas tends to be retained in solution. A particularly advantageous result has been achieved when the length L1 of the body of the helical insert 201 is selected to be approximately one inch and double start helical threads are provided at a spacing of approximately five threads per inch. The radius R2 is advantageously selected to be approximately 0.04 inches. This produces a projected area for each of the two flow paths of approximately 0.00503 square inches over the length L1. The land width X1 is preferably approximately 0.02 inches.

The upstream end of the helical insert is defined by length L2 in FIG. 17. This end cooperates with the tapered bore 228 as previously discussed to define an inlet to the helical flow paths which receives carbonated water at its full input pressure of approximately 40–55 psi. The most even inlet flow conditions to the helical path can be obtained when this end is formed as a pointed nose as shown at 201*a* of FIG. 17. Particularly advantageous flow conditions can be achieved when L2, i.e., the length of the pointed nose, is selected to be approximately 0.25 inches. The pointed nose is centered on the longitudinal axis of the helical insert and has a base diameter D1 which may be approximately 0.20 inches. The pointed or bullet nose may have a radius R1 of the outer surface of the pointed nose of approximately to be 3.62 inches as shown in FIG. 17.

In order to produce an even flow rate, the end 201*b* of the helical insert is formed as a flat tail. Use of a pointed or bullet nose at the end of the tail similar to the pointed nose was found to produce inconsistent flow conditions as the water leaving the helical flow paths would occasionally adhere to the walls of bore 228 or sometimes adhere to the bullet tail of the helical insert before separating. This phenomena caused unacceptable variations in the consistency of the flow rate and provision of a flat tail as shown at 201*b* produces clean separation of the flow from the helix and adhesion to the walls of bore 228.

In order to provide a suitably high flow rate and facilitate the production of helical inserts, side cutouts 201*c* illustrated in the plan view of bullet nose 201*a*, shown in FIG. 18, were provided. The side cutouts extend along the length L1 of the threaded portion to form bypasses around the two helical flow paths defined by the two independent set of helical threads provided on the double start helix. These two helical flow paths are partially illustrated at 201*d* and 201*e* of FIG. 17. Although a certain amount of flow bypasses the helical path, this has not been found to reduce carbonation unacceptably. As shown in FIG. 18, the cutouts are formed in radially outward most portion of the threads at diameter D3 and end at radially inward diameter D2 which may be approximately 0.22 inches. As previously noted, it is possible to use a single start helix having only one flow path over length L1 in which case the projected area of the flow path may be twice the projected area of the single flow paths of the double start helix.

The improved results obtainable with the helical flow path of the invention can be demonstrated with reference to the example given below. In this particular example, a double start helical insert having five threads per inch and the above-mentioned values of L1, L2, R1, D1, D2, D3, R2 and X2 was tested under the following conditions:

| Example 2 - Helical Insert | |
|---|---|
| Fluid medium | Carbonated water |
| Input pressure | 50 psig. |
| Flow rate | 24–28 milliliters per second |
| Input Carbonation level | 4.5 volumes of dissolved $CO_2$ |
| Output pressure | near ambient (0–2 psig.) |
| Output carbonation level | 3.7–4.1 volumes of dissolved $CO_2$ |

Thus, when tested under similar conditions the helical insert of Example 2 produced greater output carbonation levels (3.7–4.1 volumes of dissolved $CO_2$) compared to the output carbonation levels (3.1–3.4 volumes of dissolved $CO_2$) obtained with the prior art standard orifice of Example 1. The output carbonation levels produced with the invention are much closer to the input carbonation levels. Therefore, more gas remains in solution with the helical flow path of the invention, than was the case previously.

What is claimed is:

1. Apparatus for conducting a carbonated liquid under a pressure to a point which is at a pressure close to atmospheric without excessive loss of carbonation including means forming a helical flow path conducting said carbonated liquid to said point, said means comprising:

a) a tubular member having an inner circumference;
b) a helical insert having a threaded portion disposed within said tubular member with said threaded portion and said inner circumference together defining said helical flow path, said helical insert having an upstream end and a downstream end;
c) a pointed nose adjacent the upstream end of said threaded portion;
d) a flat tail adjacent the downstream end of said threaded portion; and
e) said helical flow path having a predetermined length and essentially constant cross section tending to reduce the pressure of said liquid without excessive loss of carbonation.

2. Apparatus according to claim 1 wherein said threaded portion of the helical insert comprises two independent sets of threads defining with said inner circumference two separate and parallel helical flow paths.

3. Apparatus according to claim 2 and further including at least one bypass passage formed as a cutout in said threaded portion.

4. Apparatus according to claim 3 wherein the cross sectional area of each of the helical flow paths is approximately semi-circular in shape.

5. Apparatus according to claim 4 wherein the length of the threaded portion of the helical insert equals approximately one inch, with threads formed thereon at a spacing of five threads per inch; the length of pointed nose equals approximately 0.25 inches; the outside diameter of threaded portion equals approximately 0.30 inches; the outside diameter at the base of pointed nose equals approximately 0.20 inches; and the projected cross sectional area of each helical flow path equals approximately 0.0503 square inches.

6. Apparatus according to claim 4 wherein said inner circumference of said tubular member comprises a tapered bore cooperating with the pointed nose to define an inlet to the helical flow path, said cross sectional area of the helical flow path being adjustable in dependence upon how far the helical insert is inserted within the tapered bore.

7. Apparatus according to claim 4 wherein the carbonated liquid under pressure is carbonated water.

8. Apparatus according to claim 4 in combination with a carbonator in which said carbonated water is generated comprising: a tank containing water to be carbonated, a gas inlet connected to a source of pressurized gas, means for carbonating the water within the tank, an outlet for carbonated water and said helical flow path being disposed in the interior of the tank upstream of said carbonated water outlet.

9. Apparatus according to claim 8 wherein said carbonator is removably connected to an in-home drink dispenser.

10. A method of conducting a carbonated liquid under pressure to a point which is at a pressure close to atmospheric without excessive loss of carbonation comprising the steps of:

a) forming a helical flow path of predetermined length and essentially constant cross section from a tubular member and a helical insert having a threaded portion which together with the inner circumference of the tubular member defines said helical flow path, said helical insert further having an upstream end formed with a pointed nose adjacent one end of said threaded portion and a downstream end formed as a flat tail adjacent the other end of said threaded portion; and b) conducting said carbonated liquid under pressure to an outlet at a pressure close to atmospheric via said helical flow path.

11. The method of claim 10 wherein two separate and parallel helical flow paths are formed for conducting pressurized carbonated liquid to said outlet, said flow paths comprising two independent sets of threads on said helical insert each having cross sectional flow areas approximately semi-circular in shape with at least one flow path having a bypass passage formed as a cutout-in the threaded portion.

12. The method of claim 10 further comprising the step of adjusting the cross sectional area of the helical flow path by forcing the helical insert further within the tubular member.

13. The method of claim 10 wherein said carbonated liquid is carbonated water which is conducted from a carbonator tank via said helical flow path disposed within the tank to said outlet during the step of conducting carbonated liquid.

14. Apparatus for conducting a carbonated liquid under a pressure to a point which is at a pressure close to atmospheric without excessive loss of carbonation including means forming a helical flow path conducting said carbonated liquid to said point, said means comprising:

a) a tubular member having an inner circumference;

b) a helical insert having a threaded portion disposed within said tubular member with said threaded portion and said inner circumference together defining said helical flow path, said helical insert an upstream end and a downstream end;

c) a pointed nose adjacent the upstream end of said threaded portion;

d) a flat tail adjacent the downstream end of said threaded portion;

e) at least one bypass passage formed as a cutout in said threaded portion; and f) said helical flow path having a predetermined length and essentially constant cross section tending to reduce the pressure of said liquid without excessive loss of carbonation.

* * * * *

UNITED STATES PATENT AND TRADEMARK OFFICE

CERTIFICATE OF CORRECTION

PATENT NO. : 5,037,584

DATED : August 6, 1991

INVENTOR(S) : Toll et al

It is certified that error appears in the above-identified patent and that said Letters Patent is hereby corrected as shown below:

The title page should be deleted and substitue therefor the attached title page.

Signed and Sealed this

Sixth Day of October, 1992

*Attest:*

DOUGLAS B. COMER

*Attesting Officer*

*Acting Commissioner of Patents and Trademarks*

United States Patent [19]

Toll et al.

[11] Patent Number: 5,037,584

[45] Date of Patent: Aug. 6, 1991

[54] HELICAL INSERT FOR A CARBONATOR AND METHOD OF CONDUCTING CARBONATED LIQUID

[76] Inventor: Duncan M. Toll, 48 Sharp Hill Rd., Wilton, Conn. 06897; Jonathan Kirschner, 5224 Old Mountain Ln., Powder Springs, Georgia 30073

[21] Appl. No.: 480,627

[22] Filed: Feb. 15, 1990

Related U.S. Application Data

[63] Continuation of Ser. No. 410,009, Sep. 20, 1989, abandoned, which is a continuation of Ser. No. 310,466, Feb. 15, 1989, abandoned, which is a continuation of Ser. No. 213,334, Jun. 30, 1988, abandoned.

[51] Int. Cl.[5] ..... B01F 3/04

[52] U.S. Cl. ..... 261/76; 261/DIG. 7; 366/339

[58] Field of Search ..... 261/76, DIG. 7, DIG. 16; 366/338, 339

[56] References Cited

U.S. PATENT DOCUMENTS

| | | | |
|---|---|---|---|
| 906,555 | 12/1908 | Pein | 261/DIG. 7 |
| 1,373,829 | 4/1921 | Perdue | 366/339 |
| 2,132,011 | 10/1938 | Bennett et al. | 261/DIG. 7 |
| 2,654,585 | 10/1953 | Heesen | 261/19 |
| 2,726,841 | 12/1955 | Crist | 261/DIG. 7 |
| 4,133,485 | 1/1979 | Bouvin | 366/339 |
| 4,537,513 | 8/1985 | Flesher et al. | 366/339 |

FOREIGN PATENT DOCUMENTS

| | | | |
|---|---|---|---|
| 2356595 | 5/1975 | Fed. Rep. of Germany | 366/339 |

*Primary Examiner*—Tim Miles

*Attorney, Agent, or Firm*—Kenyon & Kenyon

[57] ABSTRACT

Carbonated liquid under pressure is conducted to a point which is at a pressure close to atmospheric pressure without excessive loss of carbonation over a helical flow path formed from a tubular member having an inner circumference and a helical insert having a threaded portion disposed within the tubular member with the threaded portion and the inner circumference together defining the helical flow path. The helical insert has an upstream end formed with a pointed nose adjacent one end of the threaded portion and a downstream end formed as a flat tail adjacent the other end of the threaded portion. The helical flow path has a predetermined length and essentially constant cross section which tends to reduce the pressure of the solution without excessive loss of carbonation.

14 Claims, 11 Drawing Sheets

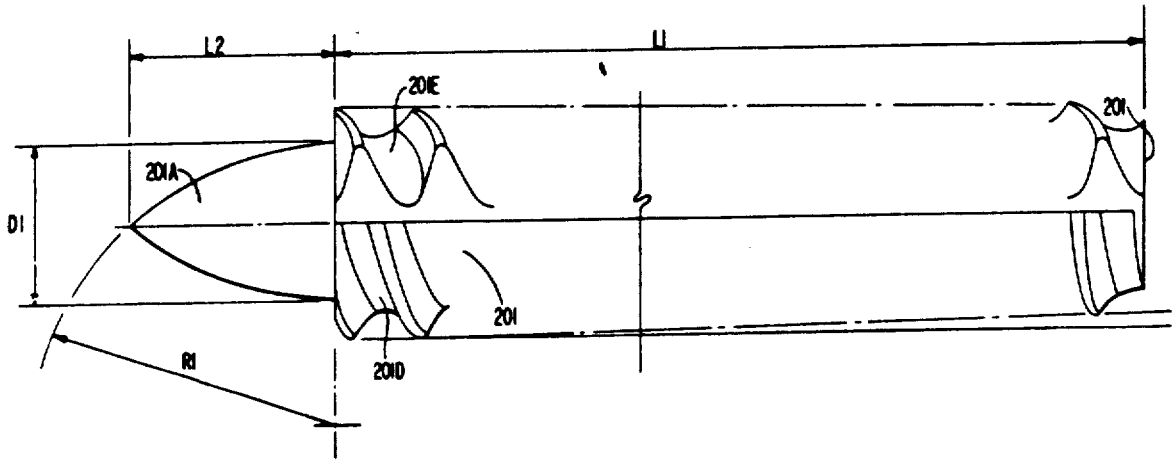

UNITED STATES PATENT AND TRADEMARK OFFICE

CERTIFICATE OF CORRECTION

PATENT NO. : 5,037,584

DATED : August 6, 1991

INVENTOR(S) : Toll, D., et al.

It is certified that error appears in the above-identified patent and that said Letters Patent is hereby corrected as shown below:

Column 1
Line 65, replace "a" with --an--.

Column 2
Line 43, replace "length" with --length of--.

Column 6
Line 2, replace "carbonated" with --carbon--.

Column 8
Line 11, replace "herein" with --herein by reference--.

Column 9
Line 52, delete "to be"

Column 10
Line 3, replace "set" with --sets--.

Column 12
Line 36, replace "insert an" with --insert having an--.

Signed and Sealed this

Twenty-third Day of March, 1993

*Attest:*

STEPHEN G. KUNIN

*Attesting Officer*

*Acting Commissioner of Patents and Trademarks*